US007331684B2

(12) United States Patent
Tung

(10) Patent No.: US 7,331,684 B2
(45) Date of Patent: Feb. 19, 2008

(54) SUNSHADE WITH AN ILLUMINATING DEVICE

(76) Inventor: Benson Tung, No. 587, Chiengong Rd., Kaohsiung (TW)

( * ) Notice: Subject to any disclaimer, the term of this patent is extended or adjusted under 35 U.S.C. 154(b) by 287 days.

(21) Appl. No.: 11/143,081

(22) Filed: Jun. 2, 2005

(65) Prior Publication Data

US 2006/0272686 A1 Dec. 7, 2006

(51) Int. Cl.
*F21L 4/08* (2006.01)

(52) U.S. Cl. ..... 362/102; 362/183; 362/249; 135/16; 135/910

(58) Field of Classification Search ..... 362/102, 362/183, 249, 234, 431, 450; 135/16, 910, 135/28, 20.3
See application file for complete search history.

(56) References Cited

U.S. PATENT DOCUMENTS

| | | | | |
|---|---|---|---|---|
| 2,087,537 | A | 7/1937 | Finkel | |
| 4,848,385 | A | 7/1989 | Pennella | |
| 6,017,188 | A | 1/2000 | Benton | |
| 6,439,249 | B1 | 8/2002 | Pan et al. | |
| 6,612,713 | B1 | 9/2003 | Kuellbs | 362/102 |
| 6,830,058 | B2 * | 12/2004 | Li | 135/16 |
| 6,840,657 | B2 | 1/2005 | Tung | |
| 2003/0000557 | A1 | 1/2003 | Lai | |
| 2003/0000559 | A1 | 1/2003 | Wu | |
| 2004/0149325 | A1 | 8/2004 | Kuellbs | 135/20.3 |

FOREIGN PATENT DOCUMENTS

| | | |
|---|---|---|
| CA | 2190035 | 5/1998 |
| EP | 0534021 | 9/1991 |
| JP | 03141906 | 6/1991 |
| NL | 9301852 | 5/1995 |
| TW | 256706 | 2/2005 |
| WO | 9300840 | 1/1993 |

* cited by examiner

*Primary Examiner*—Sharon E. Payne
(74) *Attorney, Agent, or Firm*—Alan Kamrath; Kamrath & Associates PA

(57) ABSTRACT

A sunshade includes a post having a rib-mounting member mounted thereon. A plurality of ribs, each having a rib end, are pivotally connected to the rib-mounting member. A runner is slidably mounted on the post. A plurality of stretchers each have a stretcher end pivotally connected to an intermediate portion of an associated rib and a runner end pivotally connected to the runner. An illuminating device is mounted in the runner or the rib-mounting member. Damage to the illuminating device is avoided, as the light modules and the wires of the illuminating device are hidden in the runner or the rib-mounting member.

28 Claims, 8 Drawing Sheets

SUNSHADE WITH AN ILLUMINATING DEVICE

BACKGROUND OF THE INVENTION

1. Field of the Invention

The present invention relates to a sunshade with an illuminating device for providing outdoor illumination.

2. Description of the Related Art

A sunshade shields people from sunlight and is thus widely used in outdoor cafes and rest areas as well as on beaches. An illuminating device is attached to a sunshade for illumination purposes. To eliminate the need of an external power source for the illuminating device, U.S. Pat. No. 6,840,657 discloses a sunshade with an illuminating device comprising a plurality of light units and a solar energy receiver for receiving solar energy and providing electricity to the light units. However, the light units and the wires for electrical connection are exposed on the ribs and thus liable to be damaged due to impact. Further, the structure of the illuminating device is complicated, which also leads to troublesome wiring and assembling procedures.

SUMMARY OF THE INVENTION

An objective of the present invention is to provide a sunshade with an illuminating device that is mounted in a runner or a rib-mounting member for avoiding damage to the illuminating device.

In accordance with an aspect of the present invention, a sunshade includes a post having a rib-mounting member mounted thereon, a plurality of ribs each having a rib end pivotally connected to the rib-mounting member, a runner slidably mounted on the post, a plurality of stretchers each having a stretcher end pivotally connected to an intermediate portion of an associated rib and a runner end pivotally connected to the runner, and an illuminating device mounted in the rib-mounting member or the runner.

Preferably, a solar energy device is mounted on the sunshade for receiving solar energy and transforming solar energy into electricity. The solar energy device is electrically connected to the illuminating device. Thus, an external power source is not required.

Preferably, the solar energy device comprises a base mounted on the rib-mounting member and a solar energy receiver mounted on top of the base.

Preferably, the solar energy receiver comprises at least one photoelectric plate and at least one solar cell electrically connected to the photoelectric plate.

Preferably, the sunshade further comprises a stop mounted on the post above the runner for preventing further upward movement of the runner after the sunshade is unfolded.

Preferably, the runner or the rib-mounting member comprises a plurality of compartments. The illuminating device comprises a plurality of light modules respectively and removably mounted in the compartments and electrically connected to the solar energy device. This allows easy replacement of the light modules when desired.

Preferably, the illuminating device comprises two common wires to which each light module is electrically connected. A first conductive pin is mounted on an end of each common wire. The illuminating device further comprises two wires each having an upper end electrically connected to the solar energy device and a lower end. A second conductive pin is mounted on the lower end of each wire. The light modules are turned on when the sunshade is in an unfolded state in which the first conductive pins are respectively in contact with the second conductive pins. The light modules are turned off when the sunshade is not in the unfolded state in which the first conductive pins are disengaged from the second conductive pins. Thus, the light modules are automatically turned off when the sunshade is not in use.

Preferably, the sunshade further comprises a battery mounting portion for receiving at least one cell that is adapted to be electrically connected to the illuminating device. Preferably, the battery mounting portion is provided on the runner.

In accordance with another aspect of the present invention, at least one lighting element is mounted in the rib-mounting member or the runner.

Other objects, advantages, and novel features of the invention will become more apparent from the following detailed description when taken in conjunction with the accompanying drawings.

BRIEF DESCRIPTION OF THE DRAWINGS

FIG. 5 is a view similar to FIG. 4, wherein the illuminating device is on.

FIG. 6 is a view similar to FIG. 3, wherein the illuminating device is on.

DETAILED DESCRIPTION OF THE PREFERRED EMBODIMENTS

Figure 1:
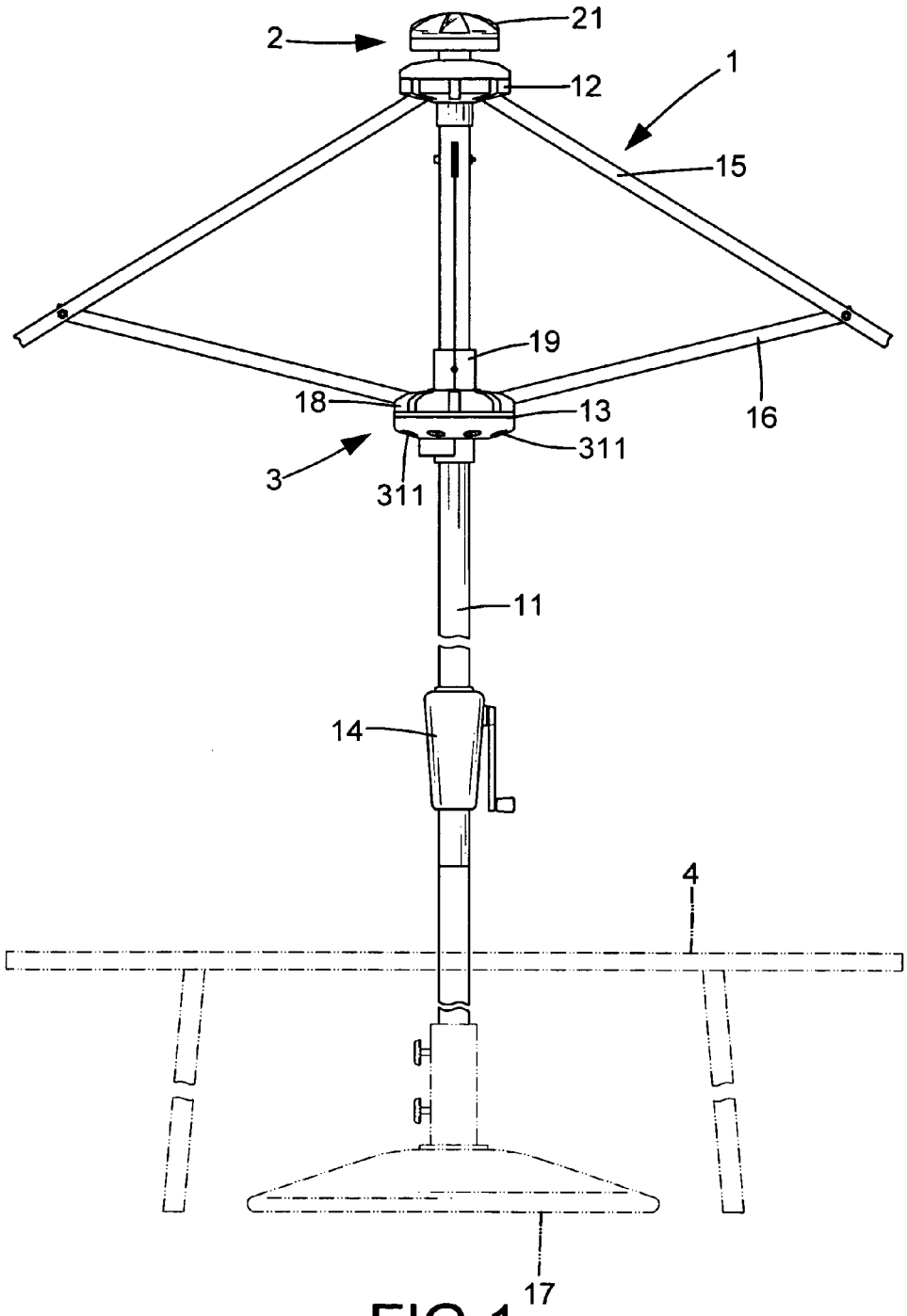
FIG. 1 is a side view of a sunshade equipped with an embodiment of an illuminating device in accordance with the present invention.

Referring to FIG. 1, an illuminating device 3 in accordance with the present invention is attached to a sunshade 1 that generally comprises a post 11, a rib-mounting member 12 on top of the post 11, a plurality of ribs 15 each having an end pivotally connected to the rib-mounting member 12, a runner 13 slidably mounted to the post 11, a plurality of stretchers 16 each having a first end pivotally connected to the runner 13 and a second end pivotally connected to an intermediate portion of an associated one of the ribs 15. A reel 14 is provided to the post 11 for unfolding and folding the sunshade 1. A stop 19 is mounted on the post 11 and located above the runner 13 for preventing further upward movement of the runner 13 after the sunshade 1 is unfolded. A base 17 is mounted to a lower end of the post 11 for providing a stable support.

Figure 2:
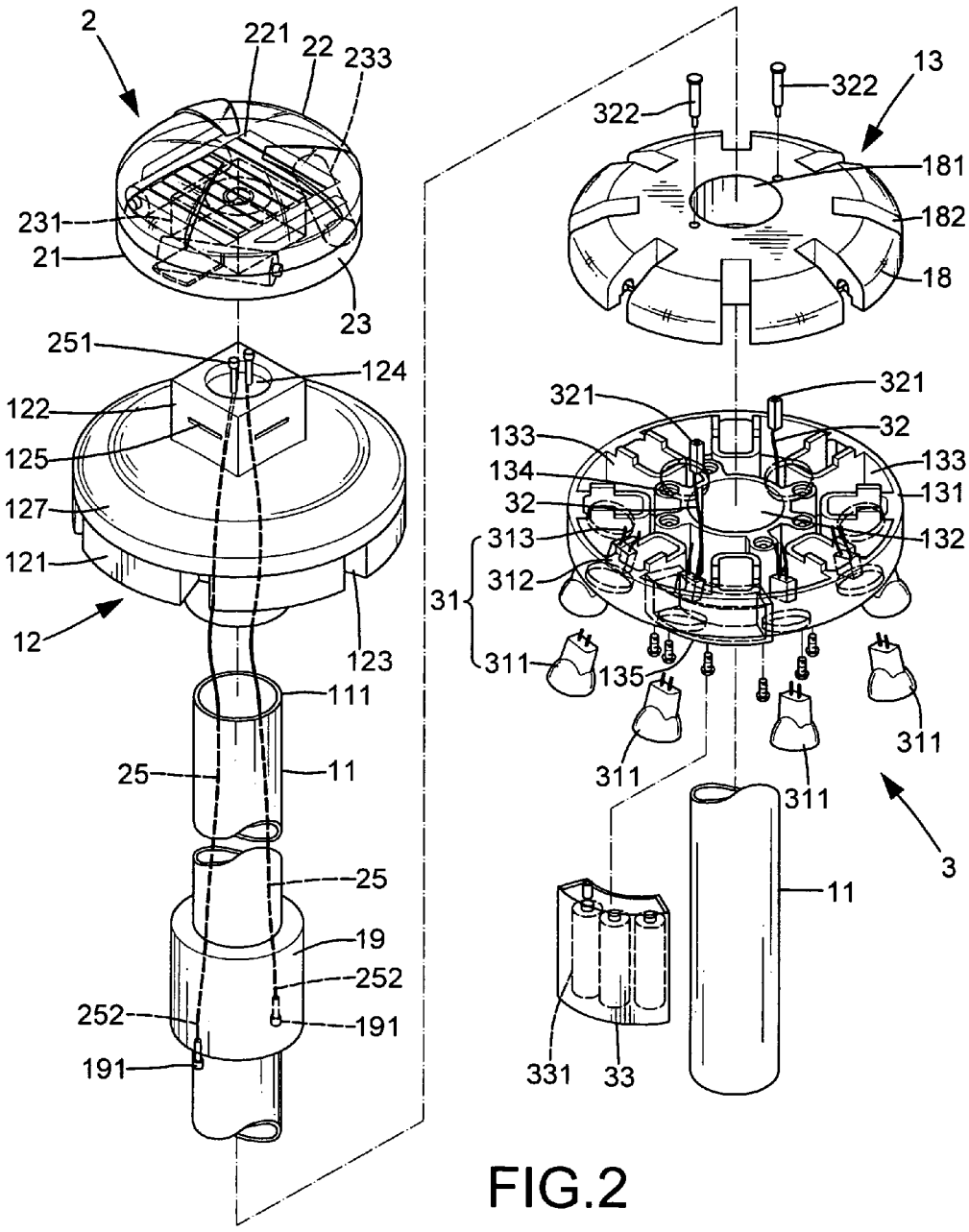
FIG. 2 is an exploded perspective view of the illuminating device in FIG. 1.
Figure 3:
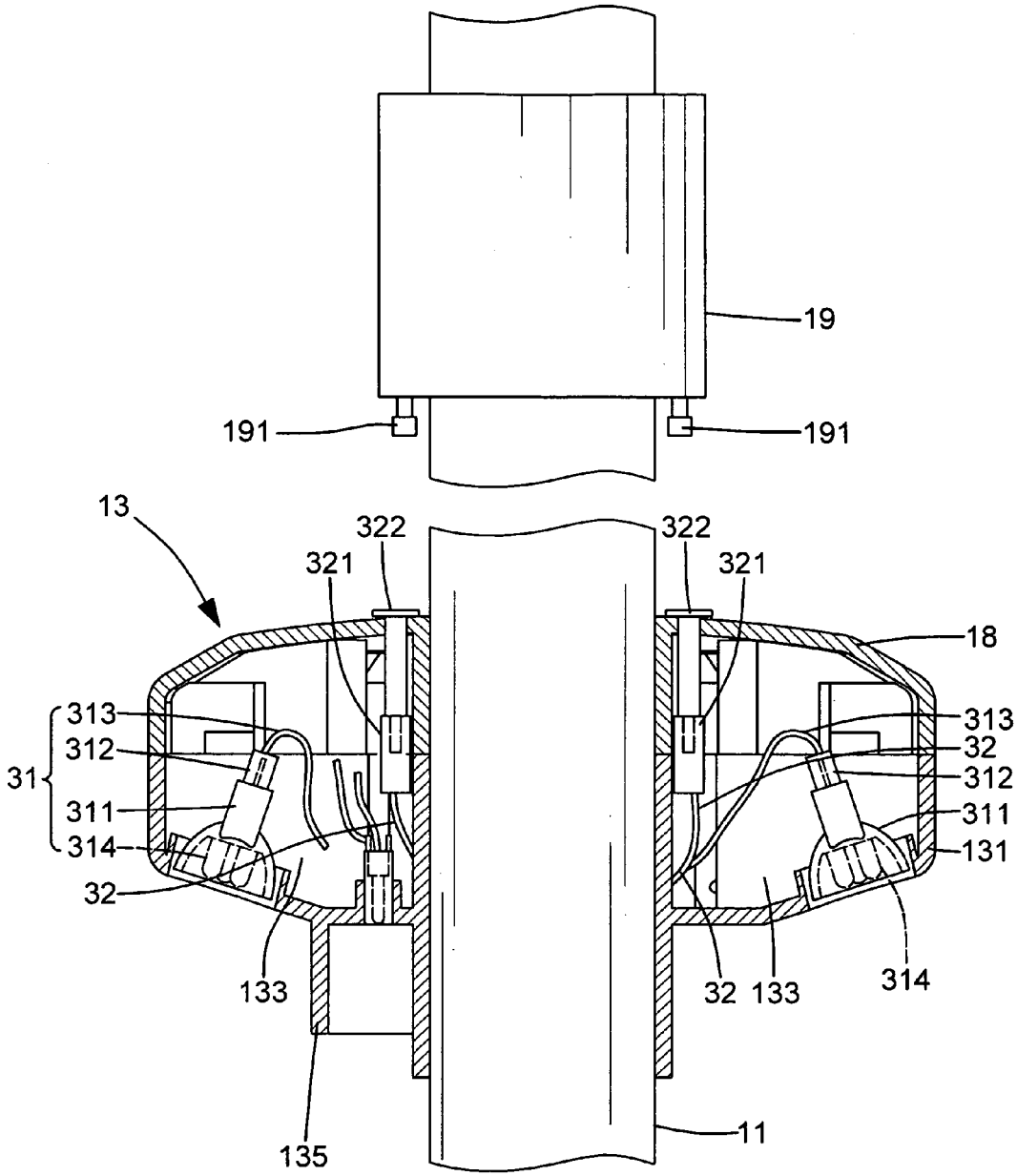
FIG. 3 is a sectional view of a portion of the sunshade in FIG. 1.
Figure 4:
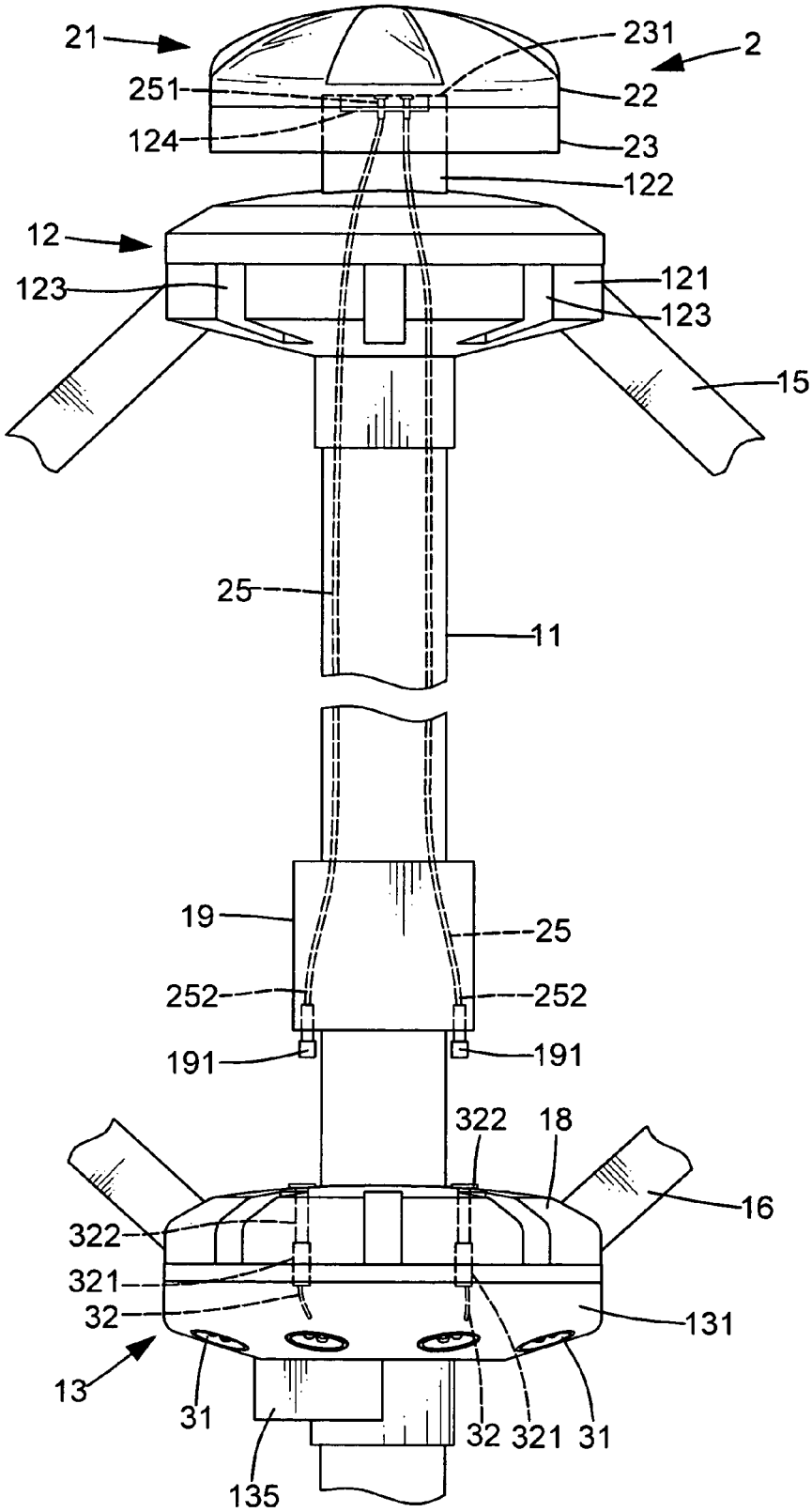
FIG. 4 is a side view of an upper portion of the sunshade in FIG. 1, wherein the illuminating device is off.

Still referring to FIG. 1 and further to FIGS. 2 through 4, the illuminating device 3 in accordance with the present invention includes at least one light unit 31 (eight in this embodiment) mounted in the runner 13. In the illustrated embodiment, the runner 13 comprises a runner body 131 and a cover 18 mounted on top of the runner body 131. The runner body 131 includes a through-hole 132 through which the post 11 extends. The runner body 131 further includes at least one compartment 133 (eight in this embodiment) for accommodating an associated light unit 31. The cover 18 includes a through-hole 181 through which the post 11 extends. The cover 18 further includes a plurality of notches 182 for accommodating and allowing pivotal movements of lower ends of the stretchers 16. The cover 18 may be fixed on the runner body 131 by extending fasteners (such as screws, not labeled) through screw holes 134 in the runner body 131 into the cover 18.

Still referring to FIGS. 2 and 3, each light unit 31 includes a light module 311 and a connector 312. Two common wires 32 are provided for electric connection with a power source. Each connector 312 is electrically connected to the common wires 32 by wires 313. Each common wire 32 includes an end electrically connected to each connector 312, and another connector 321 is mounted on the other end of each common wire 32, which will be described later. Each light module 311 includes at least one lighting element 314 (three light-emitting diodes in this embodiment, see FIG. 3). Alternatively, each light module 311 is a single lighting element of any type. Each light module 311 is removably mounted in an associated compartment 133 by any conventional method to allow replacement when desired.

Referring to FIGS. 1, 2, and 4, in the illustrated embodiment, the power source may be a solar energy device 2 comprising a solar energy receiver 21. The solar energy receiver 21 includes a base 23 mounted on top of the rib-mounting member 12 and a transparent cover 22 mounted on the base 23. The rib-mounting member 12 includes a body 121 with a plurality of notches 123 for accommodating and allowing pivotal movements of rib ends of the ribs 15. A coupling seat 122 is provided on top of the base 23 and includes a through-hole 124 in communication with the longitudinal hole 111 of the post 11. Further, positioning slots 125 are defined in a perimeter wall of the coupling seat 122. In the illustrated embodiment, a cover 127 is mounted on top of the body 121 and the coupling seat 122 is formed on top of the cover 127.

The base 23 of the solar energy receiver 21 includes a groove 231 in an underside thereof for receiving the coupling seat 122, with positioning members (not shown) formed on a perimeter wall delimiting the groove 231 being engaged with the positioning slots 125, thereby fixing the solar energy receiver 21 on the coupling seat 122. At least one photoelectric plate 221 and at least one solar cell 233 (three in this embodiment) are mounted between the base 23 and the cover 22. Solar energy is received by the photoelectric plate 221 and transformed into electricity that is stored in the solar cells 233.

As illustrated in FIGS. 2 and 4, two wires 25 are provided and each includes a conductive pin 251 on an upper end thereof and a conductive pin 191 on a lower end 252 thereof. The conductive pins 251 are electrically connected to the solar cells 233. The wires 25 extend through the hole 124 of the coupling seat 122 into the longitudinal hole 111 of the post 11, with the lower ends 252 of the wires 25 extending into the stop 19 and with the conductive pins 191 being located outside the stop 19.

Still referring to FIGS. 2 and 4, two conductive pins 322 are provided and each extends through the cover 18, with an upper end of each conductive pin 322 being located outside the cover 18 and with a lower end of each conductive pin 322 being electrically coupled to an associated connector 321. All of the lighting modules 311 are turned on when the conductive pins 322 come into contact with the conductive pins 191.

Figure 5:
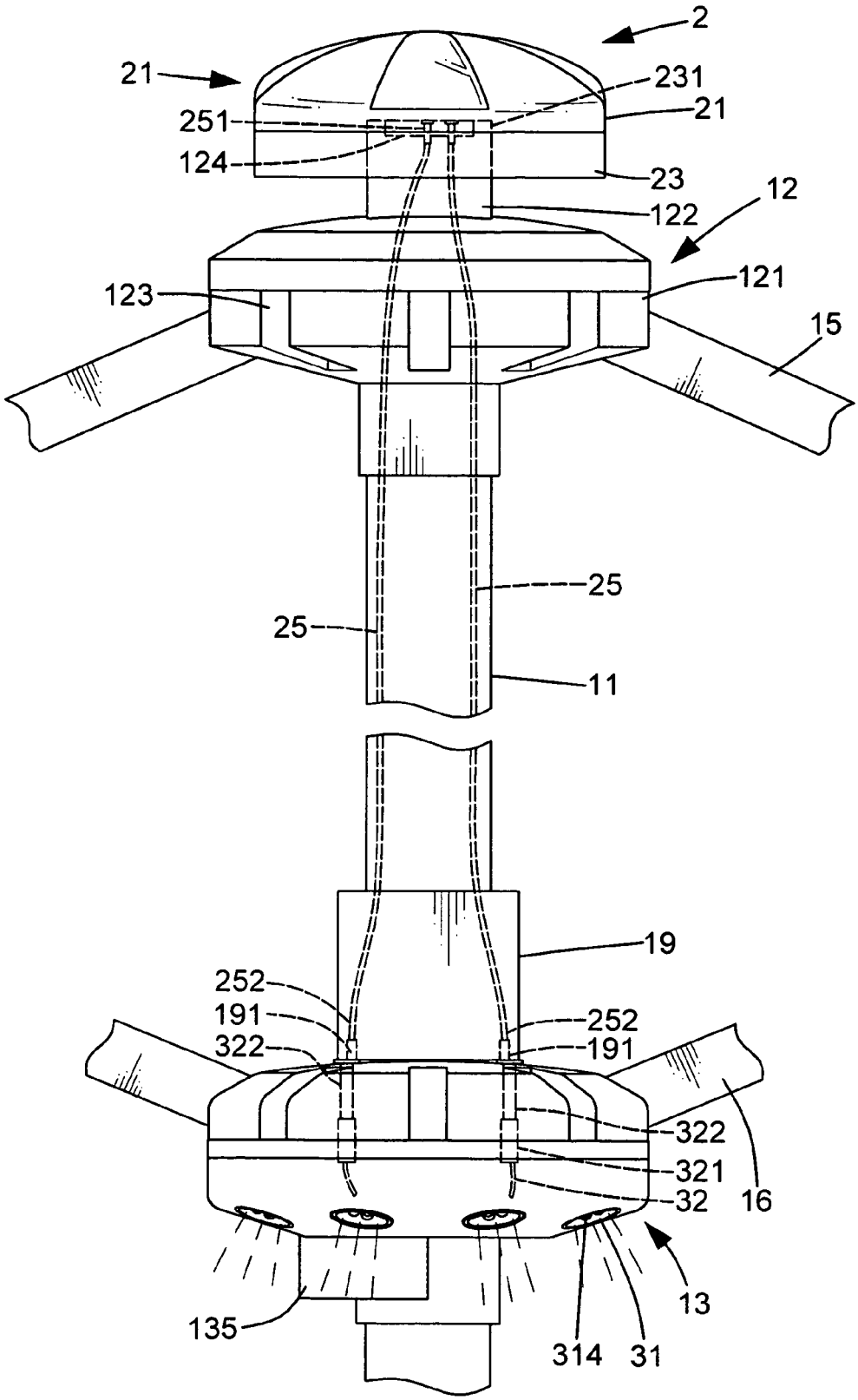
Figure 6:
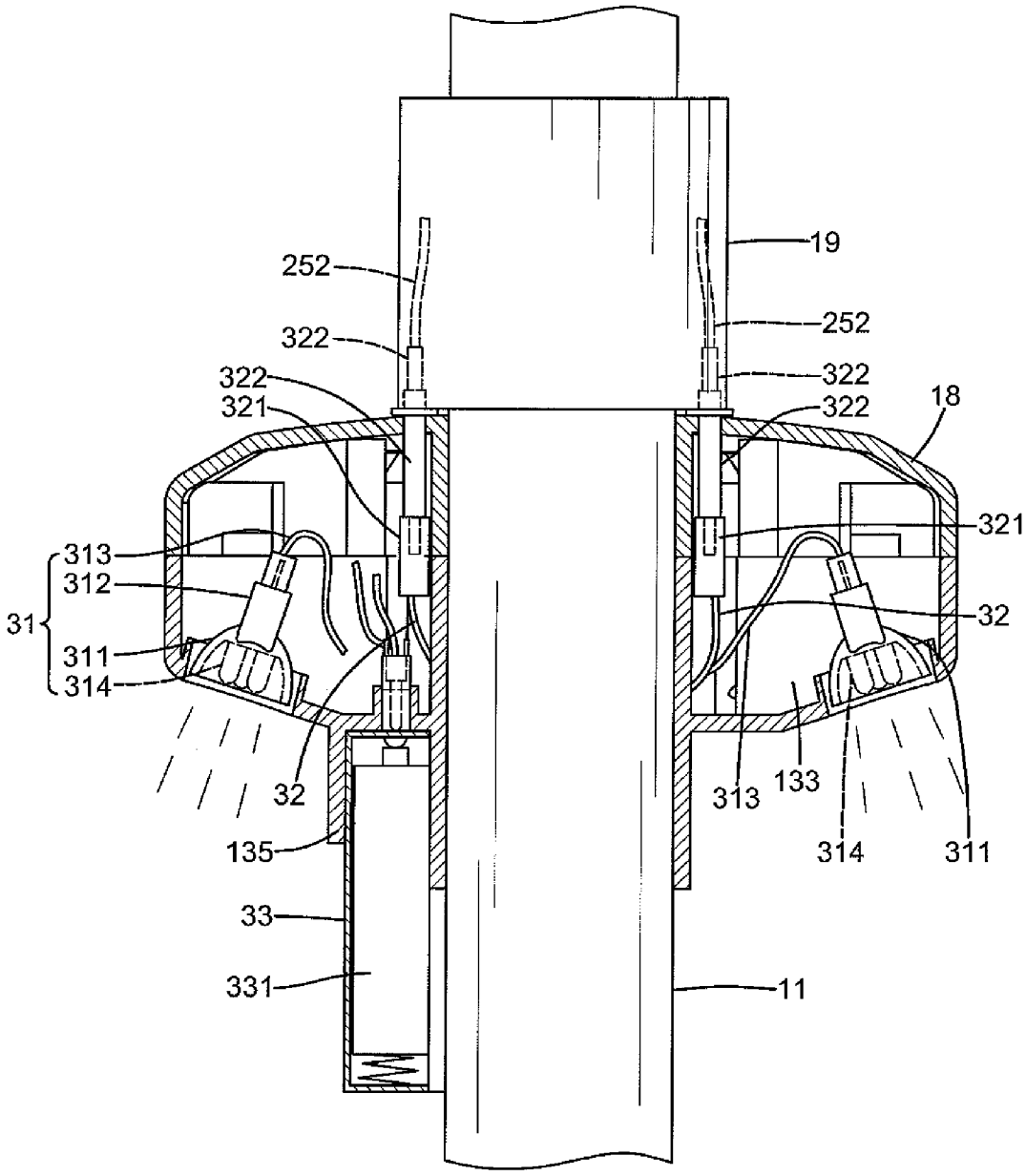

When the runner 13 is moved upward for unfolding the sunshade 1, the runner 13 is stopped by the stop 19, with the conductive pins 322 being in contact with the conductive pins 191, as shown in FIGS. 5 and 6. Electricity from the solar cell 233 is supplied to the illuminating device 3 via the wires 25 and 32. and the light elements 314 are lit to provide illumination. When the runner 13 is moved downward, the light elements 314 are turned off, as the conductive pins 322 are disengaged from the conductive pins 191, as shown in FIGS. 3 and 4. Thus, the light modules 311 are automatically turned off when the sunshade 1 is not in use.

The illuminating device 3 is mounted in the runner 13 and thus not exposed. In other words, damage to the lighting elements 314 and the wires 32. 313, and 25 are less likely to occur. Further, the illuminating device 3 has a simple structure and thus allows easy assembling. Further, in a case that the sunshade 1 is mounted adjacent to a table 4 (FIG. 1), the illuminating effect provided by the illuminating device 3 on the runner 13 for the table 4 is better than that mounted on the ribs 15.

Figure 7:
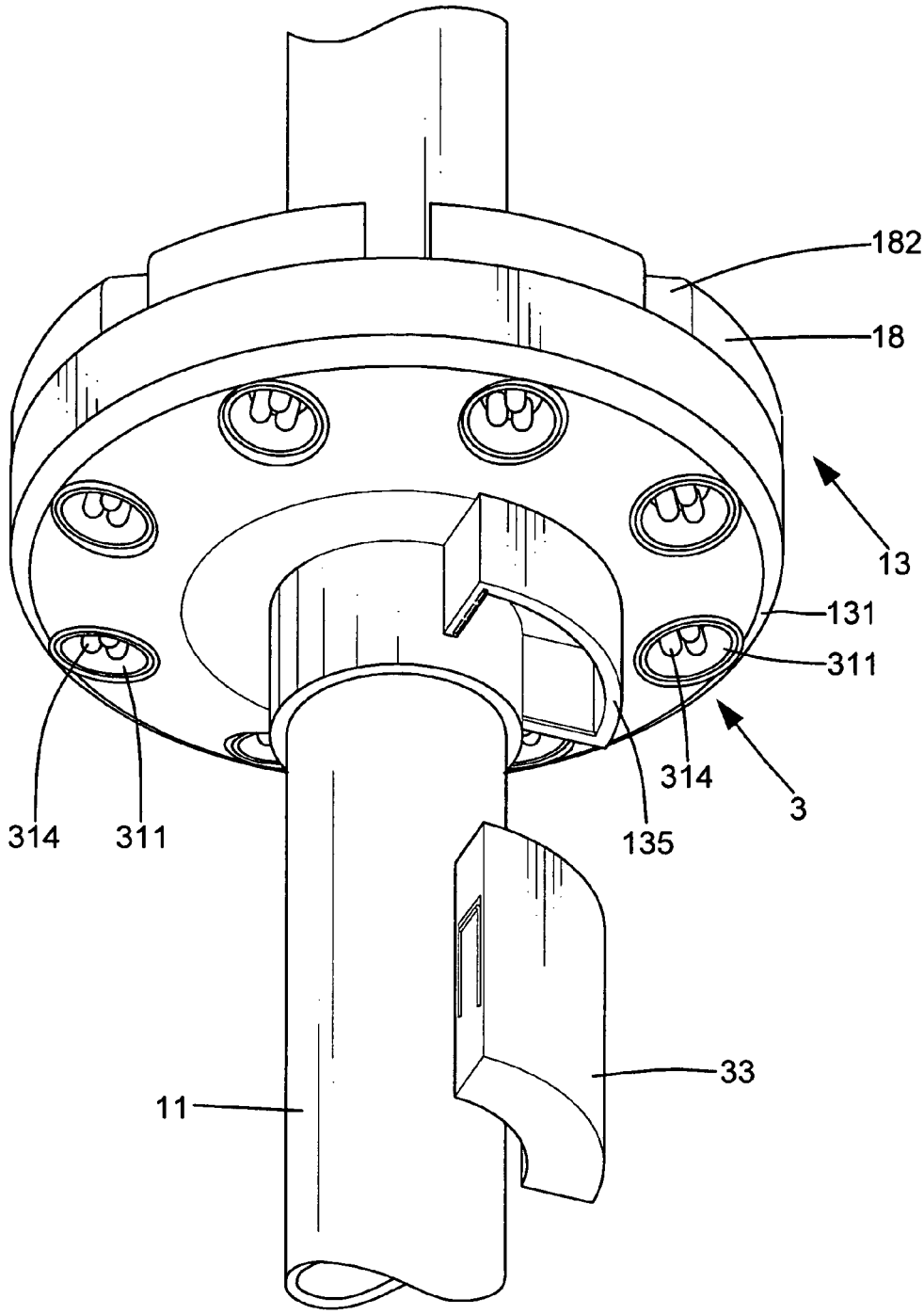
FIG. 7 is a partial bottom perspective view illustrating a battery-mounting portion of the illuminating device.

Referring to FIGS. 6 and 7, the runner body 131 of the runner 13 may further include a battery-mounting portion 135 for accommodating a battery unit 33 having at least one cell 331 electrically connected to one of the light module 311 for supplying electricity when the solar energy device 2 could not provide sufficient electricity or malfunctions.

Figure 8:
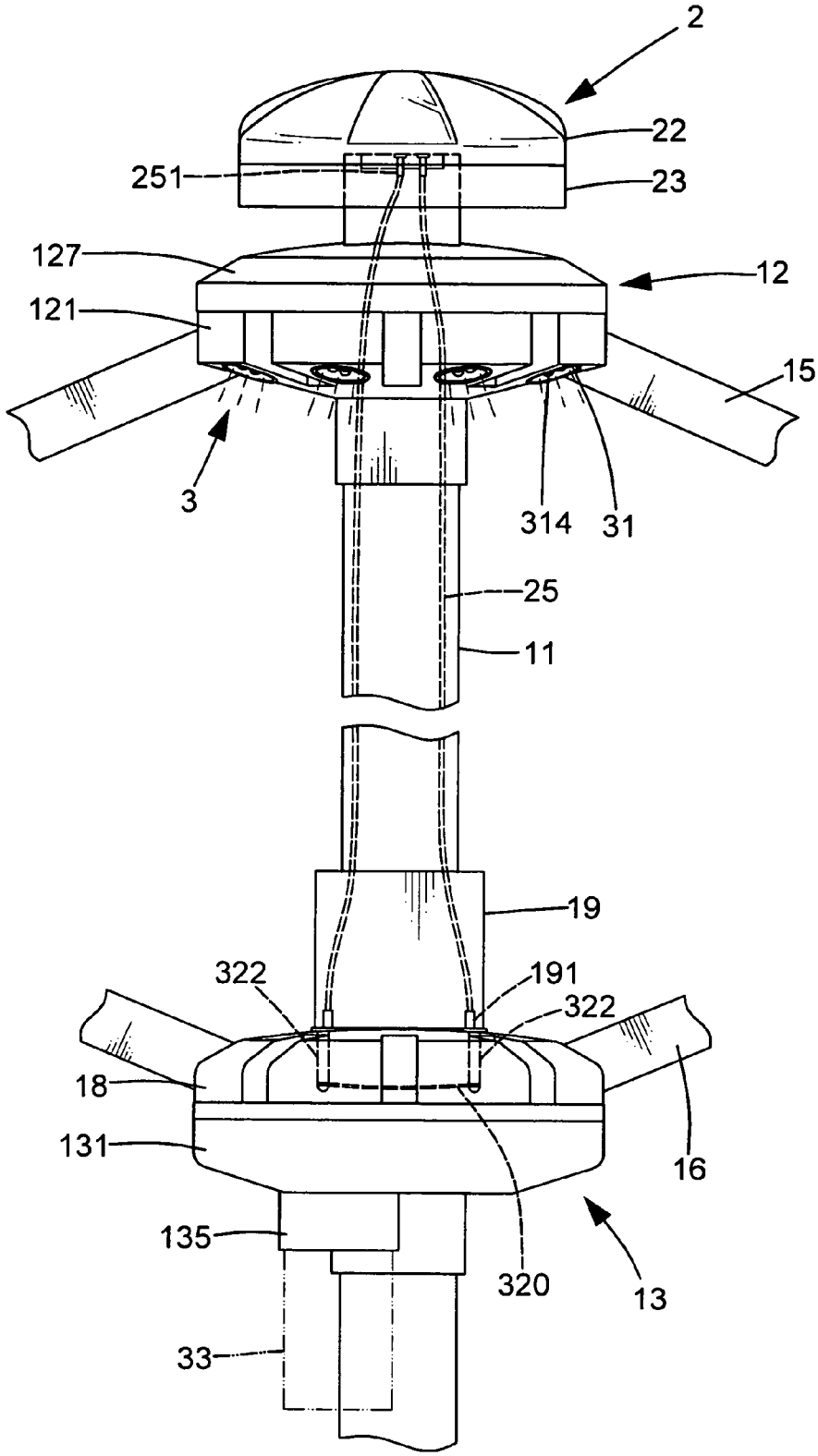
FIG. 8 is a side view illustrating an alternative embodiment of the illuminating device.

FIG. 8 illustrates an alternative arrangement of the illuminating device 3. In this arrangement, the illuminating device 3 is mounted in the rib-mounting member 12 instead of the runner 13. Similar to the arrangement shown in FIGS. 1 through 7, the rib-mounting member 12 includes a plurality of compartments (not shown) for receiving the light modules 31 of the illuminating device 3. Each light unit 31 includes a light module 311 that is electrically connected to the wires 25. Two conductive pins 322 are mounted on the cover 18 of the runner 13 electrically connected with each other via a wire 320. Each wire 25 has a conductive pin 251 on an upper end thereof for electrical connection with the solar energy receiver 21 and a conductive pin 191 on a lower end thereof. Detailed description of the structure of the illuminating device 3 is not given to avoid redundancy. Similar to the arrangement shown in FIGS. 1 through 7, the lighting elements 314 are turned on when the conductive pins 322 come into contact with the conductive pins 191 and the lighting elements 314 are turned off when the conductive pins 322 are disengaged from the conductive pins 191. Further, similar to the arrangement shown in FIGS. 1 through 7, a battery unit 33 may be mounted to the mounting portion 135 of the runner 13 and include at least one cell 331 for supplying electricity when the solar energy device 2 could not provide sufficient electricity or malfunctions.

Although the invention has been explained in relation to specific embodiments, it is to be understood that many other possible modifications and variations can be made without departing from the scope of the invention as hereinafter claimed.

What is claimed is:

1. A sunshade comprising:

a post having a rib-mounting member mounted thereon;

a plurality of ribs each having a rib end pivotally connected to the rib mounting member;

a runner slidably mounted on the post;

a plurality of stretchers each having a stretcher end pivotally connected to an intermediate portion of an associated one of the ribs and a runner end pivotally connected to the runner; and an illuminating device mounted in one of the runner and the rib-mounting member;

with said one of the runner and the rib-mounting member comprising a body including a receiving space for accommodating the illuminating device and a cover removably mounted to the body, and with the cover being removable to allow access to the receiving space.

2. The sunshade as claimed in claim 1, further comprising a solar energy device for receiving solar energy and transforming solar energy into electricity, and with the solar energy device being electrically connected to the illuminating device.

3. The sunshade as claimed in claim 1, with the receiving space of the body of said one of the runner and the rib-mounting member comprising a plurality of compartments, with the plurality of light modules respectively and removably mounted in the plurality of compartments, and with the cover being removably mounted to cover the plurality of compartments of the body of said one of the runner and the rib-mounting member.

4. The sunshade as claimed in claim 3, with the plurality of compartments being defined in the body, and with each said light module being directly removable from an associated one of the plurality of compartments to an outside of the body.

5. The sunshade as claimed in claim 3, with the illuminating device further comprising a plurality of connectors received in the receiving space of the body, and with each said connector having a first end electrically connected to a power source and a second end to which an associated one of the light modules is removably and electrically coupled.

6. The sunshade as claimed in claim 5, further comprising a stop mounted on the post above the runner for preventing further upward movement of the runner in the unfolded state, and with the second conductive pins being mounted on the stop.

7. The sunshade as claimed in claim 3, further comprising a solar energy device for receiving solar energy and transforming solar energy into electricity, and with the light modules being electrically connected to the solar energy device.

8. The sunshade as claimed in claim 4, further comprising a solar energy device for receiving solar energy and transforming solar energy into electricity, and with the light modules being electrically connected to the solar energy device.

9. A sunshade comprising:

a post having a rib-mounting member mounted thereon;

a plurality of ribs each having a rib end pivotally connected to the rib mounting member;

a runner slidably mounted on the post;

a plurality of stretchers each having a stretcher end pivotally connected to an intermediate portion of an associated one of the ribs and a runner end pivotally connected to the runner; and an illuminating device mounted in one of the runner and the rib-mounting member, with the illuminating device comprising a plurality of light modules, two first wires each having a module end to which each said light module is electrically connected and a pin end, with a first conductive pin being mounted on the pin end of each said first wire, with the illuminating device further comprising two second wires each having an upper end electrically connected to a power source and a lower end, with a second conductive pin being mounted on the lower end of each said second wire, with the plurality of stretchers movable between an unfolded state and a folded state, with the plurality of light modules being turned on in the unfolded state in which the first conductive pins are respectively in contact with the second conductive pins, and with the plurality of light modules being turned off in the folded state in which the first conductive pins are disengaged from the second conductive pins.

10. The sunshade as claimed in claim 9, further comprising a stop mounted on the post above the runner for preventing further upward movement of the runner in the unfolded state, and with the second conductive pins being mounted on the stop.

11. The sunshade as claimed in claim 9, with the plurality of compartments being defined in the body, and with each said light module being directly removable from an associated one of the plurality of compartments to an outside of the body.

12. The sunshade as claimed in claim 9, with the illuminating device comprising a plurality of light modules and a plurality of connectors, with each said connector having a first end electrically connected to a power source and a second end to which an associated one of the light modules is removably and electrically coupled.

13. The sunshade as claimed in claim 11, further comprising a solar energy device for receiving solar energy and transforming solar energy into electricity, and with the light modules being electrically connected to the solar energy device.

14. A sunshade comprising:

a post having a rib-mounting member mounted thereon;

a plurality of ribs each having a rib end pivotally connected to the rib mounting member;

a runner slidably mounted on the post;

a plurality of stretchers each having a stretcher end pivotally connected to an intermediate portion of an associated one of the ribs and a runner end pivotally connected to the runner;

at least one lighting element removably mounted in one of the runner and the rib-mounting member;

said one of the runner and the rib-mounting member comprising a battery mounting portion being arcuate in shape concentric to the post and extending through an angle smaller than 360° circumferentially around the post; and a battery unit including a housing removably mounted in the battery mounting portion, with the housing slideably receivable in the battery mounting portion, and with at least one cell mounted in the housing and electrically connected to said at least one lighting element.

15. The sunshade as claimed in claim 14, further comprising a solar energy device for receiving solar energy and transforming solar energy into electricity, the solar energy device being electrically connected to said at least one lighting element.

16. The sunshade as claimed in claim 15, with said one of the runner and the rib-mounting member comprising a body including a receiving space for accommodating said at least one lighting element, a cover removably mounted to the body, with the cover being removable to allow access to the receiving space and at least one compartment for removably receiving said at least one lighting element, with said at least one lighting element respectively and removably mounted in said at least one compartment with the cover being removably mounted to cover said at least one compartment.

17. The sunshade as claimed in claim 16, with said at least one lighting element comprising two first wires each having an element end to which said at least one lighting element is electrically connected and a pin end, with a first conductive pin being mounted on the pin end of each said first wire, with the sunshade further comprising two second wires each having an upper end electrically connected to the solar energy device and a lower end, with a second conductive pin being mounted on the lower end of each said second wire, with the plurality of stretchers movable between an unfolded state and a folded state, with said at least one lighting element being turned on in the unfolded state in which the first conductive pins are respectively in contact with the second conductive pins, and with said at least one lighting element being turned off in the folded state in which the first conductive pins are disengaged from the second conductive pins.

18. The sunshade as claimed in claim 16, with said one of the runner and the rib-mounting member comprising a body including at least one compartment for accommodating said at least one lighting element and a cover removably mounted to the body and located opposite to the battery mounting portion, and with the cover being removable to allow access to said at least one compartment.

19. The sunshade as claimed in claim 17, with said one of the runner and the rib-mounting member comprising a body including at least one compartment for accommodating said at least one lighting element and a cover removably mounted to the body and located opposite to the battery mounting portion, and with the cover being removable to allow access to said at least one compartment.

20. The sunshade as claimed in claim 18, further comprising at least one connector having a first end electrically connected to each of the battery unit and the solar energy device and a second end to which said at least one lighting element is removably and electrically coupled.

21. The sunshade as claimed in claim 19, further comprising at least one connector having a first end electrically connected to each of the battery unit and the solar energy device and a second end to which said at least one lighting element is removably and electrically coupled.

22. The sunshade as claimed in claim 14, with said one of the runner and the rib-mounting member comprising a body including at least one compartment for accommodating said at least one lighting element and a cover removably mounted to the body and located opposite to the battery mounting portion, and with the cover being removable to allow access to said at least one compartment.

23. The sunshade as claimed in claim 17, further comprising a stop mounted on the post above the runner for preventing further upward movement of the runner in the unfolded state, and with the second conductive pins being mounted on the stop.

24. The sunshade as claimed in claim 22, further comprising at least one connector having a first end electrically connected to the battery unit and a second end to which said at least one lighting element is removably and electrically coupled.

25. The sunshade as claimed in claim 23, with said one of the runner and the rib-mounting member comprising a body including at least one compartment for accommodating said at least one lighting element and a cover removably mounted to the body and located opposite to the battery mounting portion, and with the cover being removable to allow access to said at least one compartment.

26. The sunshade as claimed in claim 14, with said one of the runner and the rib-mounting member comprising a body including a receiving space for accommodating said at least one lighting element, a cover removably mounted to the body, with the cover being removable to allow access to the receiving space and at least one compartment for removably receiving said at least one lighting element, with said at least one lighting element respectively and removably mounted in said at least one compartment with the cover being removably mounted to cover said at least one compartment.

27. The sunshade as claimed in claim 26, further comprising at least one connector having a first end electrically connected to the battery unit and a second end to which said at least one lighting element is removably and electrically coupled.

28. The sunshade as claimed in claim 25, further comprising at least one connector having a first end electrically connected to each of the battery unit and the solar energy device and a second end to which said at least one lighting element is removably and electrically coupled.

* * * * *